United States Patent [19]

Rembold

[11] Patent Number: 4,508,090

[45] Date of Patent: Apr. 2, 1985

[54] METHOD AND APPARATUS FOR CONTROLLING THE SUPERCHARGER OF AN INTERNAL COMBUSTION ENGINE

[75] Inventor: Helmut Rembold, Stuttgart, Fed. Rep. of Germany

[73] Assignee: Robert Bosch GmbH, Stuttgart, Fed. Rep. of Germany

[21] Appl. No.: 549,185

[22] Filed: Nov. 4, 1983

[30] Foreign Application Priority Data

Nov. 6, 1982 [DE] Fed. Rep. of Germany ..... 3241024

[51] Int. Cl.[3] ..... F02D 23/00

[52] U.S. Cl. ..... 123/564

[58] Field of Search ..... 123/559, 564, 565

[56] References Cited

U.S. PATENT DOCUMENTS

| | | | |
|---|---|---|---|
| 1,630,634 | 5/1927 | Porsche | 123/559 |
| 1,878,210 | 9/1932 | Vincent | 123/559 |

FOREIGN PATENT DOCUMENTS

| | | | |
|---|---|---|---|
| 705718 | 5/1941 | Fed. Rep. of Germany | 123/559 |
| 605158 | 2/1926 | France | 123/565 |
| 1263461 | 5/1961 | France | 123/559 |
| 451193 | 7/1936 | United Kingdom | 123/565 |

*Primary Examiner*—Michael Koczo
*Attorney, Agent, or Firm*—Walter Ottesen

[57] ABSTRACT

The invention is directed to a method and apparatus for controlling the charger of an internal combustion engine as required by the operator of the vehicle. A first switch switches in the charger by energizing a relay when the accelerator pedal is depressed down to the end of the full-load position thereof. A second switch is connected in series with the first switch and interrupts the supply circuit for the relay thereby switching out the charger when the angular position of the throttle valve has dropped below a predetermined value. Self-holding contacts of the relay are connected in parallel with and bridge the first switch. In this way, the full-load curve without the charger switched in corresponds approximately to the curve defining engine operation with charger where switch-out of the charger is about to occur. In lieu of switching out the charger by releasing the accelerator pedal to a position corresponding to a predetermined constant angular position value of the throttle valve, this value at which switch-out occurs can be made dependent upon the rotational speed of the engine.

10 Claims, 4 Drawing Figures

METHOD AND APPARATUS FOR CONTROLLING THE SUPERCHARGER OF AN INTERNAL COMBUSTION ENGINE

BACKGROUND OF THE INVENTION

In internal combustion engines equipped with a charger, the latter directs air under elevated pressure to the combustion chambers of the engine to increase the power delivered thereby and it is known to switch in the charger as required to obtain the increased power. For example, this was done with the earliest compressor motors. The compressor could be arbitrarily switched in by the driver as deemed necessary; however, this could be done for only a short time in order to prevent damage to the motor.

The most common present day chargers are turbochargers, which are driven at high rotational speeds by a turbine wheel of the engine and deliver pre-pressurized air to the combustion chamber of the engine. A disadvantage here is the relatively abrupt switch-in of the charger after a predetermined rotational speed (rpm) threshold has been reached. Beneath this threshold the internal combustion engine does not offer any substantial power because of the low initial pressurization at a comparatively low operating efficiency.

SUMMARY OF THE INVENTION

In view of the foregoing, it is an object of the invention to provide an apparatus for controlling the charger to shift its operation to the range of availability desired by the driver of a vehicle equipped with such an engine. With the apparatus of the invention, the driver can switch in the charger, for example, by moving the accelerator pedal into a full-load position. On the other hand, the charger operation can be retained for a predetermined range of variation also after the accelerator pedal is withdrawn to a mid position so that the power available from the additional charger can continue to be used and, especially, an unpleasant switch-in and switch-out of the charger is avoided.

The invention therefore makes possible charger operation as required in intermediate ranges whereby the driver has the option to retain the additional power afforded by the charger or, to drive with low fuel consumption and at a good efficiency.

The apparatus of the invention therefore controls the charger of an internal combustion engine of a motor vehicle as required by the operator of the vehicle. The engine has a first characteristic curve of torque vs. rotational speed (rpm) indicative of full-load engine operation with charger switched out and a second characteristic curve of torque vs. rotational speed (rpm) defining the condition at which the charger is about to be switched out.

The apparatus of the invention can include: charger actuating means coupled to the charger for switching the charger in and out of the air supply system of the internal combustion engine; first switch means for energizing the actuating means and switching in the charger when the engine is operating at full-load to increase the torque delivered by the engine beyond that indicated by the first characteristic curve; torque adjustment means for reducing the torque delivered by the engine to a lower value of torque whereat said first and second characteristic curves correspond to each other at least within a range of higher values of rpm; self-holding means for holding the actuating means in the energized condition while reducing the torque delivered by the engine to the lower value thereof; and, second switch means connected to the torque adjustment means so as to be actuable when the lower value of torque is reached for releasing the self-holding means thereby causing the actuating means to become deenergized to switch out the charger.

Further advantages are available as will be made clear from the following. In this connection, it is noted that according to one preferred embodiment of the invention, the switch-out of the charger does not occur at a predetermined return position of the throttle valve, that is, it does not occur at a constant angle of the throttle valve; instead, the switch-out occurs in consonance with the rotational speed of the internal combustion engine.

It is also an object of the invention to provide a method of controlling the charger of an internal combustion engine of a motor vehicle as required. It is again noted that the engine has a first characteristic curve of torque vs. rotational speed (rpm) indicative of full-load engine operation with the charger switched out and a second characteristic curve of torque vs. rotational speed (rpm) defining the condition at which the charger is about to be switched out.

The method includes the steps of: switching in the charger when the engine is operating at full-load to increase the torque delivered by the engine beyond that indicated by said first characteristic curve; holding the charger in its switched-in condition while simultaneously reducing the torque delivered by the engine to a lower value of torque where the second characteristic curve and the first characteristic curve correspond to each other at least within a range of higher values of rpm; and, switching out said charger directly after the torque has been reduced to said lower value thereof so that the engine again operates without the charger.

BRIEF DESCRIPTION OF THE DRAWING

The invention will now be described with reference to the drawing wherein.

DESCRIPTION OF THE PREFERRED EMBODIMENTS OF THE INVENTION

The invention is based on the concept of increasing the power of an internal combustion engine, as required, by charging the same by means of a charger which can be mechanically switched in. By means of this arrangement, it is possible, for example, to reduce the volumetric displacement of an engine or motor of an available size and to obtain a desired higher output power during specific times as required by means of a charger that can be switched in. When the charger is switched out, the motor has an improved efficiency when delivering the same operating performance as the motor originally discussed above. This motor of improved efficiency is smaller because of the application of the concept of the invention. This operation with improved efficiency leads to a substantial reduction in the amount of fuel required which can be up to twenty percent.

Figure 1:
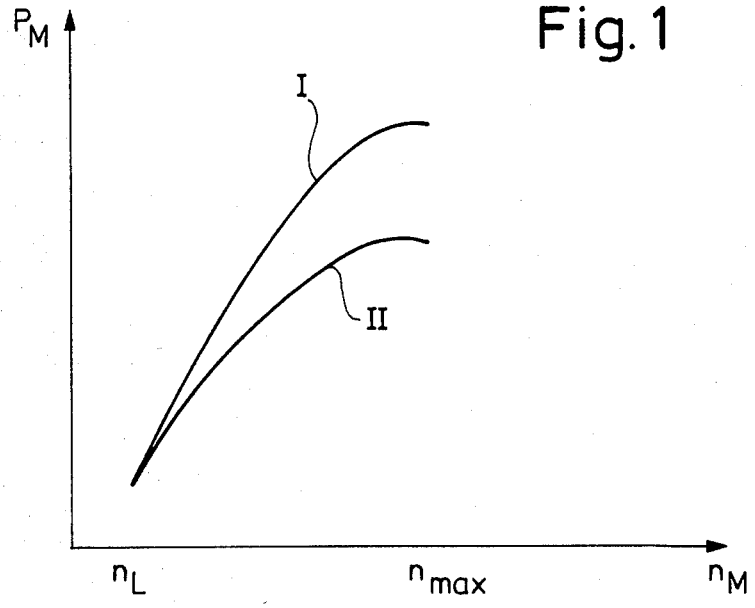
FIG. 1 is a graph showing the power delivered by an internal combustion engine as a function of rotational speed with and without the charger.

For example, the charger can be switched in by a switch arranged with respect to the accelerator pedal. The switch is actuated at full-load and then effects the switch-in of the charger via a magnetic coupling. With the charger switched in in this manner, the motor power shown in FIG. 1 is always provided only during the time that the accelerator pedal is in its full-load position. When the accelerator pedal is withdrawn, a motor power $P_M$ is provided which is in part substantially less. This last-mentioned motor power is graphically depicted in FIG. 1 by the curve II and extends over the entire range of motor rotational speed available during operation of the motor vehicle from no-load speed $n_L$ to $n_{max}$.

The invention makes it possible to drive with a charger, that is, with an additionally activated power capacity of the motor, in an intermediate power range which is available when the accelerator pedal is released or withdrawn from its full-load or full-gas position.

Figure 3:
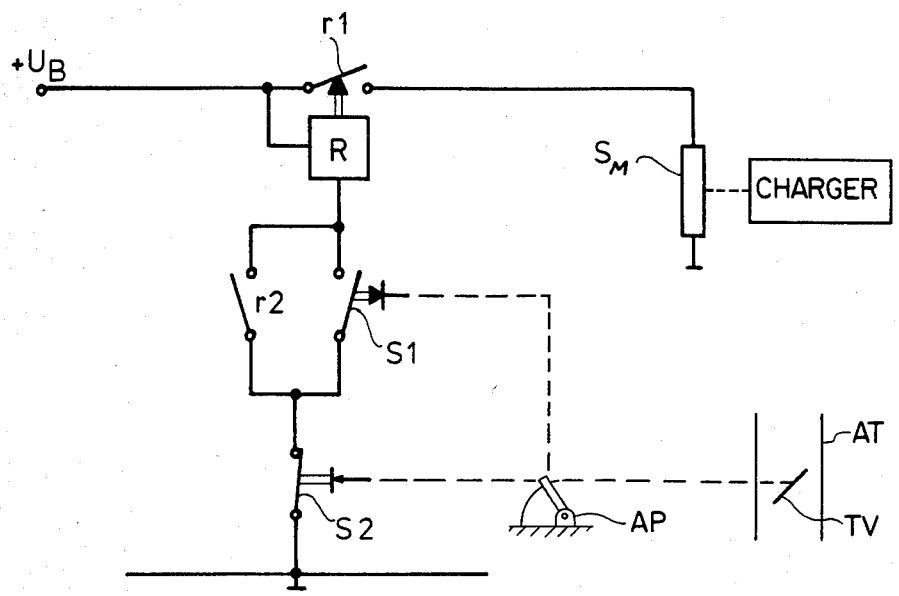
FIG. 3 is a schematic showing an embodiment of the invention wherein the charger switch-out occurs when the angular position of the throttle valve drops below a predetermined constant value; and, FIG. 4 is a schematic of another embodiment of the invention wherein circuit means are provided to define a variable switch-out curve of the charger which is dependent upon rotational speed and the angular position of the throttle valve.

Referring now to FIG. 3, the reference designation $S_M$ identifies charger actuating means in the form of a magnetic coupling which effects the switch-in of the charger. The magnetic coupling $S_M$ becomes energized and switches in the charger when a supply voltage $+U_B$ is applied to the coil $S_M$ via a switch r1, the latter being actuated by relay R.

The relay R is connected in series with a first accelerator pedal switch S1 actuable when the accelerator pedal AP is depressed all the way down and in series with a second accelerator pedal switch S2. The second switch S2, too, is actuateable by the pedal AP and is then in its closed, current-conducting position when the accelerator pedal has reached and exceeded a predetermined depressed position corresponding to a definite opening angle of the throttle valve TV of, for example, $\alpha_o$=60 to 65°. The throttle valve TV can be mounted, for example, in the air-induction tube AT of the air supply system of the internal combustion engine. The range of the angle $\alpha_o$ of 60 to 65° can vary somewhat from engine to engine.

Finally, the relay R has a further switch r2 which is connected in parallel to the first switch S1 and can therefore bridge the latter.

The switch positions shown in FIG. 3 correspond to the operation of the internal combustion engine for a position of the accelerator pedal wherein the predetermined throttle valve angle $\alpha_o$ has been exceeded but wherein the pedal is not in the full-load position. Accordingly, the following operation is obtained.

The charger is switched-in via the switch S1 arranged with respect to the accelerator pedal AP when the latter is depressed all the way down. This is like a kick-down and the driver realizes the start of the charging. The relay R is connected to the supply voltage $+U_B$ via switches S1 and S2 which are connected in series and then closes its first switching contact r1. At the same time, the relay R closes its self-holding contact r2 so that a withdrawal from the full-load position or fully depressed position of the accelerator pedal is possible without this leading immediately to a switch-out of the charger.

According to a first embodiment of the invention, the switch-out of the charger occurs when the accelerator pedal AP is released by the driver to the extent that the pedal position corresponds to an opening angle $\alpha_o$ corresponding to a throttle valve angle of approximately 60 to 65°. In this situation, the second accelerator pedal switch S2 opens and removes the supply voltage $+U_B$ from the relay R.

Figure 2:
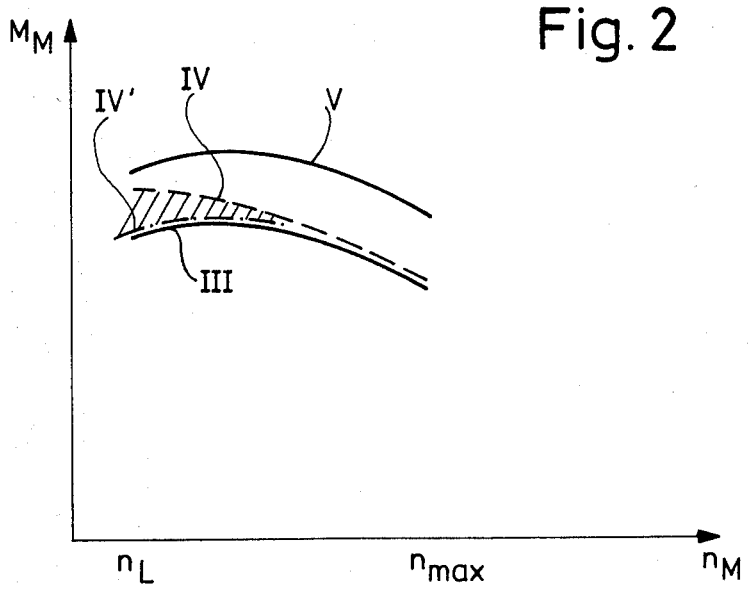
FIG. 2 is a graph of the torque delivered by an internal combustion engine as a function of rotational speed for the following: full-load with charger switched in (curve V); full-load without the charger switched in (curve III); engine operating with charger and at a load where switch-out of the charger is about to occur for a constant throttle angle (curve IV); and, engine operating with charger where switch-out of the charger is about to occur and where circuit means are provided for defining the dependence of the throttle valve angular position for charger switch-out upon rotational speed of the engine (curve IV')

The throttle valve angle $\alpha_o$ for this embodiment is assumed to be constant and should be so selected that the full-load curve III without charger operation shown in FIG. 2 corresponds to the switch-out curve IV with charger operation. The full-load curve with charger operation is designated by reference numeral V and corresponds to the situation wherein the driver has depressed the accelerator pedal all the way down so as to actuate switch S1.

The characteristic curves of FIG. 2 show the available motor torque $M_M$ plotted against the range of rotational speed (rpm) from no-load speed $n_L$ to full-load speed $n_{max}$.

The switch-out curve IV shows the torque for any speed in this range for the condition wherein the charger is about to be switched out; that is, it shows the torque delivered by the engine when the driver has released the accelerator pedal to the position where the switch S2 is about to be actuated.

From the shape of switch-out curve IV at a throttle valve angle $\alpha_o$=constant, it is apparent that in the lower rpm range, the switch-out curve IV departs from the full-load curve III without charger; whereas, in the upper rpm range, a good coincidence is obtained.

Thus, in the upper rpm range and after having released the pedal and opened switch S2 (charger switched out), the power delivered by the engine will fall; however, the driver can again get the same torque as he had immediately before the charger switched out by merely pressing down on the accelerator pedal thereby operating the engine in the full-load without charger switched in (curve III). Of course, if the driver would depress the accelerator to the very end of its stroke, the switch S1 would close and the driver would be operating on curve V.

However, the departure of the curves III and IV at lower speeds means that when the given throttle valve angle is exceeded by releasing the accelerator pedal so that switch S2 opens (thereby switching out the charger operation), the torque at the time of charger switch-out cannot again be attained when the driver (at this rpm) moves the accelerator pedal AP to full-load but not to the very end of its stroke.

This is so because curve III defines the upper maximum of torque available without charger action. Accordingly, the hatched area between curves III and IV cannot be reached at lower values of rpm.

On the other hand, it is evident that the power can be increased without the charger in the lower rpm range by selecting another gear providing a higher motor rpm. Accordingly, the control of the charger operation provided by this embodiment of the invention affords a satisfactory solution over the ranges of rpm and throttle valve angle which are available.

According to another embodiment of the invention, the full-load curve III and the switch-out curve IV with charger operation can be made to better coincide with each other by means of a corresponding change of the function of the $\alpha$-switch-out value with respect to the motor rotational speed (rpm) n.

Figure 4:
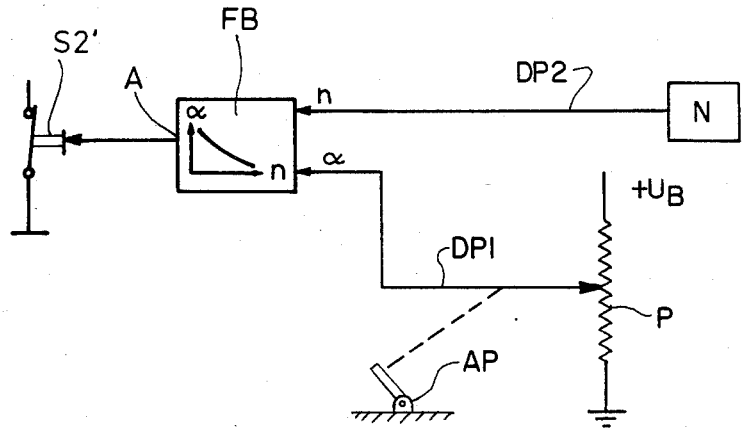

FIG. 4 is a schematic representation of a function block FB which can include a function curve of the dependence of the switch-out angle $\alpha$ on the rpm (rotational speed) n of the motor. The function curve can be stored in basically any desired form.

The function block FB is configured so as to cause it to compare the stored function curve with actual values of $\alpha$ and n obtained from the operating engine and, when there is coincidence, the function block FB generates an open signal A at its output which is transmitted to the second switch S2 causing the latter to open thereby causing the relay R to become deenergized. This in turn causes switch r1 to open thereby deenergizing the magnetic coupling $S_M$ and switching out the charger.

The predetermined function curve of the dependence of the opening angle $\alpha$ on the rotational speed n can be generated in the function block FB by a function generator or it can be stored in any other desired analog manner or especially in a digital manner.

With analog storage and analog comparison, the $\alpha$ values can be generated by means of a potentiometer P on the accelerator pedal and then fed to the function block FB via data path DP1. An analog voltage proportional to motor rotational speed n can be generated, for example, by integration of ignition impulses with the aid of a low pass filter and an impulse transformer connected ahead of the latter.

The rotational speed (rpm) n of the engine can also be measured with the aid of a speed sensor such as inductive transducer means N mounted at the crankshaft of the engine. The transducer means N generates a signal n proportional to rpm which is fed to function block FB via data path DP2.

With the embodiment of FIG. 4, the switch-out curve with charger (curve IV) can be shaped so that it lies as shown in FIG. 2 by the dot-dash segment IV' in the lower rotational speed range. Thus, when the driver releases the accelerator pedal AP so that it moves past the predetermined or computed $\alpha$-position so that the charger is switched out, the driver will still have control over the same torque as he had just before switch-out if he depresses the accelerator pedal AP so that he is at full load but has not floored the pedal so as to actuate switch S1. At this position, the driver is operating on the full-load curve without charger (curve III in FIG. 2). More specifically, at this position of the accelerator pedal, the torque delivered by the engine reaches the value of torque which the engine was delivering with the charger switched-in and with the accelerator pedal at the position just before the function block FB issued the signal A to actuate switch S2 to switch-out the charger.

It is understood that the foregoing description is that of the preferred embodiments of the invention and that various changes and modifications may be made thereto without departing from the spirit and scope of the invention as defined in the appended claims.

What is claimed is:

1. Method of controlling the charger of an internal combustion engine of a motor vehicle as required wherein the engine has a first characteristic curve of torque vs. rotational speed (rpm) indicative of full-load engine operation with the charger switched out and a second characteristic curve of torque vs. rotational speed (rpm) defining the condition at which the charger is about to be switched out, the method comprising the steps of:

switching in the charger when the engine is operating at full-load to increase the torque delivered by the engine beyond that indicated by said first characteristic curve;

holding the charger in its switched-in condition while simultaneously reducing the torque delivered by the engine to a lower value of torque where said second characteristic curve and said first characteristic curve correspond to each other within at least a range of higher values of rpm; and, switching out said charger directly after the torque has been reduced to said lower value thereof so that the engine again operates without the charger.

2. The method of claim 1 wherein the motor vehicle has an accelerator pedal that can be depressed to cause the engine to operate on said first characteristic curve and to also actuate a switch for switching in the charger and for activating self-holding means to keep the charger switched in after said pedal has been released, the method comprising;

depressing the accelerator pedal to actuate said switch thereby performing said step of switching in the charger; and, maintaining said charger switched in while reducing the torque delivered by the engine by maintaining said self-holding means in the activated condition until said torque has been reduced just past said lower value.

3. The method of claim 2 wherein an additional switch is arranged with respect to said accelerator pedal, said additional switch being actuable for deactivating said self-holding means in response to a release movement of said pedal when said pedal is moved past a position whereat the angle $\alpha$ of the throttle valve has been reduced below a predetermined constant value.

4. Method of controlling the charger of an internal combustion engine of a motor vehicle as required wherein the engine has a first characteristic curve of torque vs. rotational speed (rpm) indicative of full-load engine operation with the charger switched out, and wherein circuit means defines a function curve of the dependence of the throttle valve angular position $\alpha$ for charger switch-out on the rotational speed n of the engine, the method comprising the steps of:

switching in the charger when the engine is operating at full-load to increase the torque delivered by the engine beyond that indicated by said first characteristic curve;

holding the charger in its switched-in condition while simultaneously reducing the torque delivered by the engine operating with the charger switched in;

monitoring and comparing the actual values of rotational speed n and angular position $\alpha$ of the throttle valve to said function curve as the torque is reduced to generate a signal for switching out the charger thereby defining a second characteristic curve of torque vs. rotational speed (rpm) for the condition at which the charger is about to be switched out, said second characteristic curve corresponding essentially to said first characteristic curve over the entire useable speed range of the engine.

5. Apparatus for controlling the charger of an internal combustion engine of a motor vehicle as required by the operator of the vehicle, the engine having a first characteristic curve of torque vs. rotational speed (rpm) indicative of full-load engine operation with charger switched out and a second characteristic curve of torque vs. rotational speed (rpm) defining the condition at which the charger is about to be switched out, the apparatus comprising:

charger actuating means coupled to said charger for switching the charger in and out of the air supply system of the internal combustion engine;

first switch means for energizing said actuating means and switching in the charger when the engine is operating at full-load to increase the torque delivered by the engine beyond that indicated by said first characteristic curve;

torque adjustment means for reducing the torque delivered by the engine to a lower value of torque whereat said first and second characteristic curves correspond to each other at least within a range of higher values of rpm;

self-holding means for holding said actuating means in the energized condition while reducing the torque delivered by the engine to said lower value thereof; and, second switch means connected to said torque adjustment means so as to be actuable when said lower value of torque is reached for releasing said self-holding means thereby causing said actuating means to become deenergized to switch out the charger.

6. Apparatus for controlling the charger of an internal combustion engine of a motor vehicle equipped with a throttle valve and an accelerator pedal operatively connected to the throttle valve, the engine having a first characteristic curve of torque vs. rotational speed (rpm) indicative of full-load engine operation with the charger switched out and a second characteristic curve of torque vs. rotational speed (rpm) defining the condition at which the charger is about to be switched out, the apparatus comprising:

charger actuating means coupled to the charger for switching the charger in and out of the air supply system of the internal combustion engine;

relay means having a first set of relay contacts for applying a voltage to said charger actuating means for switching in the charger when said set of relay contacts are closed;

a first switch and a second switch connected in series and to said relay means for applying a voltage thereto and energizing the same, said first and second switches being actuable by the accelerator pedal in dependence upon the position of the latter;

said relay means having a second set of relay contacts connected in parallel with said first switch; and, said second switch being arranged with respect to said pedal so as to close at an intermediate point along its stroke and said first switch being closed when the pedal reaches the end of its stroke corresponding to full-load operation of the engine thereby causing said relay means to become energized whereby said first set of contacts closes to energize said charger actuation means so as to switch in the charger to increase the torque delivered by the engine beyond that indicated by said first characteristic curve and said second set of contacts closes to bridge said first switch to permit said relay means to remain energized after the pedal is released from the full-load position and said first switch reopens; and, means for opening said second switch after the accelerator pedal has been released so as to reduce the torque developed by the engine to a value whereat said first and second characteristic curves correspond to each other at least within a range of higher values of rpm, said opening of said second switch causing said relay means and said actuating means to deenergize to switch the charger out.

7. Apparatus for controlling the charger of an internal combustion engine of a motor vehicle equipped with a throttle valve and an accelerator pedal operatively connected to the throttle valve, the engine having a first characteristic curve of torque vs. rotational speed (rpm) indicative of full-load engine operation with the charger switched out and a second characteristic curve of torque vs. rotational speed (rpm) defining the condition at which the charger is about to be switched out, the apparatus comprising:

charger actuating means coupled to the charger for switching the charger in and out of the air supply system of the internal combustion engine;

relay means having a first set of relay contacts for applying a voltage to said charger actuating means for switching in the charger when said set of relay contacts are closed;

a first switch and a second switch connected in series and to said relay means for applying a voltage thereto and energizing the same, said first and second switches being actuateable by the accelerator pedal in dependence upon the position of the latter;

said relay means having a second set of relay contacts connected in parallel with said first switch; and, said second switch being arranged with respect to said pedal so as to close at an intermediate point along its stroke and said first switch being closed when the pedal reaches the end of its stroke corresponding to full-load operation of the engine thereby causing said relay means to become energized whereby said first set of contacts closes to energize said charger actuation means so as to switch in the charger thereby increasing the torque delivered by the engine beyond that indicated by said first characteristic curve and, said second set of contacts closes to bridge said first switch to permit said relay means to remain energized after the pedal is released from the full-load position and said first switch reopens;

said intermediate point along the stroke of said pedal being selected to correspond to a predetermined angle of the throttle valve; and, said second switch being adapted to again be actuated so as to reopen when the pedal is released and passes said intermediate position thereby deenergizing said relay means to in turn remove the supply voltage from said charger actuating means and switching out the charger thereby causing said second characteristic curve to essentially correspond to said first characteristic curve within at least a higher range of values of rpm.

8. The apparatus of claim 7, said predetermined angle being 60° to 65°.

9. The apparatus of claim 7 comprising switch actuation means for opening said second switch in response to an angular position of the throttle valve that changes as the gas pedal is released and in dependence upon the rotational speed of the engine thereby deenergizing said relay means to in turn remove the supply voltage from said charger actuating means and switching out the charger.

10. Apparatus for controlling the charger of an internal combustion engine of a motor vehicle in dependence upon the needs of the operator of the vehicle, the engine having a first characteristic curve of torque vs. rotational speed (rpm) indicative of full-load engine operation with charger switched out and a second characteristic curve of torque vs. rotational speed (rpm) defining the condition at which the charger is about to be switched out, the motor vehicle having a throttle valve and an accelerator pedal operatively connected to the throttle valve, the apparatus comprising:

charger actuating means coupled to said charger for switching the charger in and out of the air supply system of the internal combustion engine;

first switch means for energizing said actuating means and switching in the charger when the engine is operating at full-load to increase the torque delivered by the engine beyond that indicated by said first characteristic curve;

adjustment means for variably adjusting the angular position $\alpha$ of the throttle valve to thereby reduce the torque to a lower value thereof on said second characteristic curve over the useable range of rotational speed of the engine ($n_L$ to $n_{max}$);

self-holding means for holding said actuating means in the energized condition while reducing the torque delivered by the engine;

second switch means for releasing said self-holding means;

circuit means for defining a function curve of the dependence of the angular position of the throttle valve for charger switch-out on the rotational speed of the engine;

a rotational speed sensor for monitoring actual values of rotational speed n and supplying the same to said circuit means;

a throttle valve angular position sensor for sensing the actual values of said angular position $\alpha$ and supplying the same to said circuit means;

said circuit means including means for comparing said values from said sensors, respectively, to said function curve as the torque is reduced to generate a signal when correspondence therewith occurs for actuating said second switch means to open the same thereby releasing said self-holding means to deenergize said charger actuating means and switch out the charger; and, said function curve being stored in said circuit in such a manner that said second characteristic curve essentially corresponds to said first characteristic curve over said useable range of rotational speed of the engine.

* * * * *